US006105278A

United States Patent [19]

Gerrish et al.

[11] Patent Number: 6,105,278

[45] Date of Patent: Aug. 22, 2000

[54] METHOD AND APPARATUS FOR DRYING TIMBER

[75] Inventors: Philip Gerrish, Granham; Francis Wakefield, Bisley; Ralph Shute, Milton Keynes, all of United Kingdom

[73] Assignee: Microwave Drying Limited, Gloucestershire, United Kingdom

[21] Appl. No.: 09/043,184

[22] PCT Filed: Sep. 12, 1996

[86] PCT No.: PCT/GB96/02250

§ 371 Date: Apr. 16, 1998

§ 102(e) Date: Apr. 16, 1998

[87] PCT Pub. No.: WO97/10482

PCT Pub. Date: Mar. 20, 1997

[30] Foreign Application Priority Data

Sep. 15, 1995 [GB] United Kingdom ..... 9518885

[51] Int. Cl.[7] ..... F26B 3/347

[52] U.S. Cl. ..... 34/497; 34/264; 34/536; 34/202; 219/697

[58] Field of Search ..... 34/259, 264, 201, 34/202, 497, 524, 526, 549, 535, 536, 537, 557; 219/697, 701, 709, 750

[56] References Cited

U.S. PATENT DOCUMENTS

| | | | |
|---|---|---|---|
| 2,040,729 | 5/1936 | Cissey . | |
| 2,567,983 | 9/1951 | Wood . | |
| 3,721,013 | 3/1973 | Miller | 34/1 |
| 4,176,464 | 12/1979 | Randolph | 34/16.5 |
| 4,485,564 | 12/1984 | Iverland et al. | 34/265 |
| 5,109,595 | 5/1992 | Wickersheim et al. | 29/600 |
| 5,325,604 | 7/1994 | Little | 34/493 |
| 5,399,314 | 3/1995 | Samuel et al. | 422/34 |

FOREIGN PATENT DOCUMENTS

| | | |
|---|---|---|
| 596 029 | 10/1925 | France . |
| 2 077 953 | 11/1971 | France . |
| 2 147 456 | 3/1973 | France . |
| 867 670 | 2/1953 | Germany . |
| 27 06 025 | 8/1978 | Germany . |
| 82 01411 | 4/1972 | WIPO . |
| 82 01766 | 5/1982 | WIPO . |

*Primary Examiner*—Pamela A. Wilson
*Attorney, Agent, or Firm*—Davis and Bujold

[57] ABSTRACT

Timber drying apparatus comprises a housing defining a microwave cavity (4) for containing a quantity of timber, a microwave generator (1) coupled to the housing for introducing microwave energy into the cavity, temperature sensing means (13) arranged to sense the temperature of timber within the cavity and/or weight sensing means (8) for sensing the weight of timber within the cavity and control means for varying the power output of the microwave generator in response to the sense temperature and/or weight. The humidity and/or air temperature may also be sensed in the cavity. The timber may be oscillated within the cavity.

17 Claims, 2 Drawing Sheets

METHOD AND APPARATUS FOR DRYING TIMBER

The present invention relates to the drying or so-called seasoning of timber.

Freshly cut wood typically has a moisture content (by weight on a dry weight basis) of about 80%. If such wood were to be used immediately for the making of a timber product such as a piece of furniture, the wood would gradually dry out and in so doing would change shape and thereby distort the timber product. To avoid this problem, wood is dried to somewhere in the region of 20% to 8% moisture content for soft and hard woods respectively, before it is used for making a timber product.

Traditionally, wood has been seasoned by stacking the cut wood and leaving it to dry in the air for several years. Alternatively wood can be dried in a few weeks using a kiln.

Both of the above methods of seasoning are unsatisfactory. Since the production of seasoned timber using air drying or kiln drying takes a considerable time large stocks of wood must be held in order to ensure a constant supply of seasoned timber. The storage of large stocks of wood over a long period of time is expensive. Furthermore both processes usually require periodic restacking of the timber and, in addition, much of the wood is unusable after seasoning as a result of splits and severe distortion. Beech wood for example typically has a wastage rate of between 30% and 40% using either of the above processes.

It is an object of the present invention to provide an improved apparatus and process for drying timber.

According to a first aspect of the present invention there is provided a timber drying apparatus comprises a housing for containing a quantity of timber, temperature sensing means arranged to sense the temperature of timber within the housing, means for heating timber contained within the housing and control means for varying the means for heating the timber in response to the sensed temperature characterised in that the housing comprises or includes a cavity (4), the means for heating is a microwave generator (1) coupled to the cavity (4) by at least two ducts (2) for introducing microwave energy into the cavity (4) and weight sensing means (8) for sensing the weight of timber within the cavity (4).

Apparatus according to a first preferred version of the first aspect of the present invention is characterised by ventilation means (10, 11) arranged to displace air through the cavity (4) to regulate humidity and/or air temperature within the cavity (4). Typically the ventilation means (10, 11) includes a humidity sensor (9, 12) at an air inlet (10) to or an air outlet (11) from the cavity, the humidity sensor (9, 12) being adapted to provide a signal output representing the humidity of air in the vicinity of the sensor; the signal output being used as an input to regulate operation of the ventilation means (10, 11).

Apparatus according to a second preferred version of the first aspect of the present invention or the first preferred version thereof is characterised by a timber carriage (16) arranged to support timber within the cavity (4).

Apparatus according to a third preferred version of the first aspect of the present invention or of any preceding preferred version thereof is characterised by means (7) for the carriage (16) whereby an oscillatory and/or rotatory motion can be imparted to timber supported by the carriage (16) within the cavity (4).

Apparatus according to a fourth preferred version of the first aspect of the present invention or of any preceding preferred version thereof is characterised by stirring means (3) within the cavity (4) operable to vary spacial distribution of microwave energy within the cavity (4).

Apparatus according to a fifth preferred version of the first aspect of the present invention or of any preceding preferred version thereof is characterised by an aperture and a closure (5) therefor, the closure being openable to provide access to the interior of the cavity (4) by way of the aperture whereby timber can be inserted into or removed from the cavity. There typically there is provided a plurality of apertures (5') and closures (5) therefor and means regulating the opening or closing of the closure of each aperture on a continuous basis to periodically provide for the introduction of timber into the cavity and/or the extraction of timber from the cavity by way of one or more of the apertures. Preferably to limit the escape of microwave energy to the environment microwave chokes can be located at the or each entrance or exit to the cavity.

Apparatus according to a sixth preferred version of the first aspect of the present invention „or of any preceding preferred version thereof is characterised by temperature sensing means (13) including at least one infrared pyrometer arranged for measuring the surface temperature of wood within the cavity.

Apparatus according to an seventh preferred version of the first aspect of the present invention or of any preceding preferred version thereof is characterised by the control means (8) being operable to derive a measure of the rate of change of weight of timber located within the cavity from the sensed weight in order to derive a measurement of the rate of drying of the timber.

Apparatus according to an eighth preferred version of the first aspect of the present invention or of any preceding preferred version thereof is characterised in that the control means are arranged to control the power output of the microwave source (1) to ensure that the temperature rather than drying rate of wood within the cavity (4) is kept below a predetermined maximum.

Apparatus according to a ninth preferred version of the first aspect of the seventh or eighth preferred version of the present invention is characterised in that the control means serve to indicate that wood within the cavity (4) is sufficiently dry such as when: the drying rate of the wood over a predetermined time is zero or less than a predetermined maximum; or the total weight loss during drying is the same or more than a predetermined minimum weight loss.

Apparatus according to a tenth preferred version of the first aspect of the present invention or any preceding preferred version thereof is characterised in that the microwave generator (1) is operable to produce several different continuous or intermittent power outputs.

Apparatus according to an eleventh preferred version of the first aspect of the present invention or of any preceding preferred version thereof is characterised in that the temperature sensing means (13) includes at least one fibre optic temperature sensor.

A method according to a second aspect of the present invention of drying timber within a housing containing a quantity of timber and temperature sensing means arranged to sense the temperature of timber within the housing and means for heating timber contained within the housing along with control means for varying the means for heating the timber in response to the sensed temperature characterised by the steps of adapting the housing to serve as a microwave cavity, using a microwave generator to inject microwave energy into the cavity and thereby into timber located therein, repeatedly sensing the weight and/or temperature of timber within the cavity and controlling power injected into the cavity by the generator in response to sensed weight and/or temperature of timber in the cavity.

The carriage preferably comprises a plurality of spiders having radially arranged arms emanating from a central hub. The timber to be dried may be mounted at the distal ends of the arms and the hub is preferably rotatably mounted to an axle. By mounting the timber to be dried between two such spiders, the timber may conveniently be rotated within the microwave cavity. One or more further spiders may be mounted along the length of the timber to reduce the possibility of long lengths of timber sagging during drying.

The cavity preferably has a closable opening for the insertion of and removal of timber for drying. The cavity may be arranged to have a plurality of openings and the apparatus may thereby be operable on a continuous basis by regularly introducing new batches of timber into the cavity using, for example, a conveyor belt.

The temperature sensing means preferably includes means for measuring the surface temperature of the wood. These preferably include at least one infra-red pyrometer which are typically arranged to measure the temperature in the middle and one third of the way in from the ends of the wood. Since there is a predetermined correlation (which may be determined using internal temperature probes in conjunction with surface measurements) between internal and surface temperature for each type of wood a surface measurement is effective for measuring the internal temperature. The internal temperature itself is important since it is this which largely determines the internal pressure of the timber which builds up as the moisture is heated in the wood pores. The temperature sensing means may instead or in addition include one or more fibre optic temperature sensors. These two types of sensors have been found to be especially advantageous in the present apparatus since they are non-metallic and produce little or no masking of the microwave radiation. Furthermore in the case of the pyrometer, the sensing apparatus may be mounted outside the cavity The sensed temperature may be used as a control input to the control means to enable a predetermined temperature/time curve to be maintained during drying. For example, some wood is best dried at a relatively constant temperature. The sensed temperature alone or in combination with the sensed weight can then be used to determine an appropriate microwave generator power output. The temperature/time curve is preferably kept below a predetermined maximum temperature to avoid distortion of the timber.

By accurate control of the output power of the microwave generator, many of the problems of uncontrolled microwave irradiation of timber are avoided. Without such control, the moisture in the wood may be removed too rapidly and cause the pore structure of the timber to rupture. This leads to general distortion of the timber in the form of splits, "honeycombing" in which large holes are formed in the internal structure of the wood and "collapse" in which the honeycombing becomes so severe that it causes the wood structure to collapse.

Preferably the microwave energy is in the frequency range greater than 100 MHz and/or less than 300 GHz. Typically the frequencies (which are government approved frequencies) are 434 MHz, 896 MHz, 915 MHz, 2.45 GHz and 4.75 GHz. Longer wavelengths provide better penetration of the wood structure and are preferred for large pieces of timber. Typically, a frequency of 896 MHz permits timber up to a cumulative total of 200 mm thick to be dried. At a frequency of 2.45 GHz wood of a cumulative thickness of at least 100 mm can be dried. Larger pieces also need to be dried more slowly since the moisture tends to escape only at the end of the wood and thus the pressure build-up in the centre of the wood is greater for larger pieces.

Preferably the control means is operable to derive a measure of the rate of change of the weight of the timber from the sensed weight thereby to derive a measurement of the rate of drying of the timber (the drying rate may be derived by assuming that weight loss is due to moisture evaporating from the timber). It has been found that different types of wood have a characteristic maximum drying rate above which significant distortion of the timber occurs. Therefore the control means is preferably arranged to control the power output of the microwave source to ensure that the drying rate of the wood is kept below a predetermined maximum. The rate of weight change may also be used to determine when the wood is substantially dry. For example, the change in weight typically reduces to or very close to zero when the wood is sufficiently dry and the apparatus may be arranged to indicate that the wood is sufficiently dry when the change in weight over a predetermined time is zero or less than a predetermined maximum or the total weight loss during drying is the same or more than a predetermined minimum weight loss. Preferably the microwave generator is operable to produce several different power outputs and may be switched on and off intermittently.

According to a method aspect of the invention, a method of drying timber using microwave energy comprises placing the timber into a microwave cavity, repeatedly sensing the weight and/or temperature of the timber and controlling the power output of a microwave generator coupled to the cavity according to the sensed weight and/or temperature.

An exemplary embodiment of the invention will now be described by way of example with reference to the drawings of which:

FIGS. 1 AND 2

Figure 1:
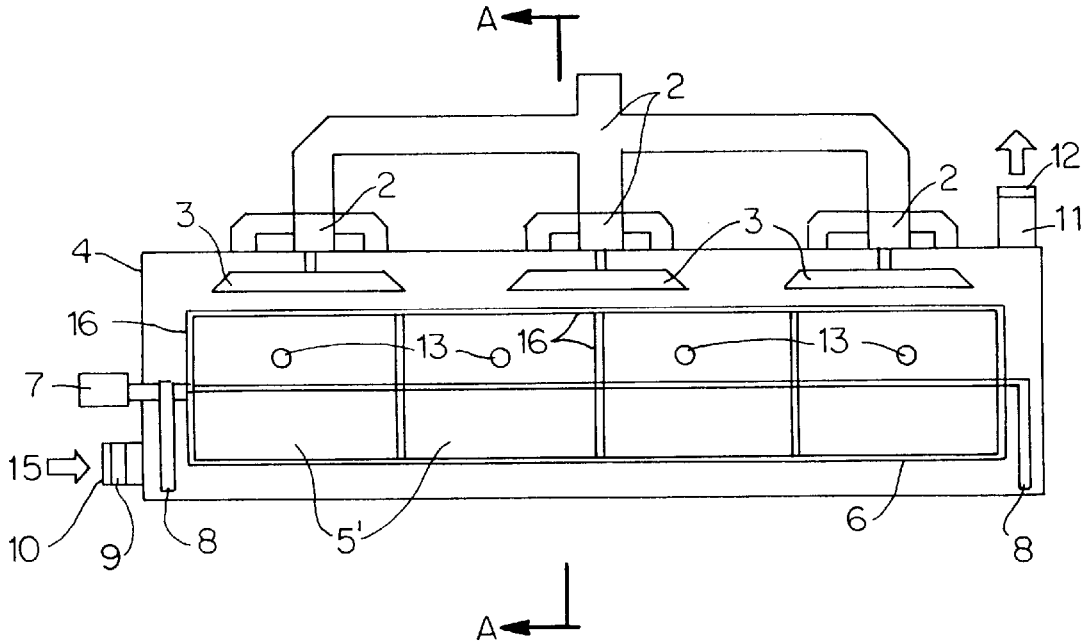
FIG. 1 is a side elevation of a timber drying apparatus.

Timber drying apparatus comprises a microwave generator 1 for generating energy in the 896 to 915 MHz bandwidth. This is coupled to a multi-mode cavity 4 by wave guides 2. The energy is coupled into the cavity 4 by mode stirrers 3 which operate in a conventional manner.

The cavity 4 has an air inlet 10 and an air outlet 11. The humidity of the air passing through the inlet 10 and outlet 11 is sensed by humidity sensors 9, 12 on the inlet and outlet respectively. To force the air through the cavity 4 a fan is mounted in the air inlet 10.

Infra-red sensors 13 are mounted in the walls of the cavity 4. In the embodiment shown four sensors 13 are mounted in the side wall. However, the location of the sensors may be varied and should be chosen to give consistent and accurate measurement of the surface temperature of timber within the cavity 4.

Figure 2:
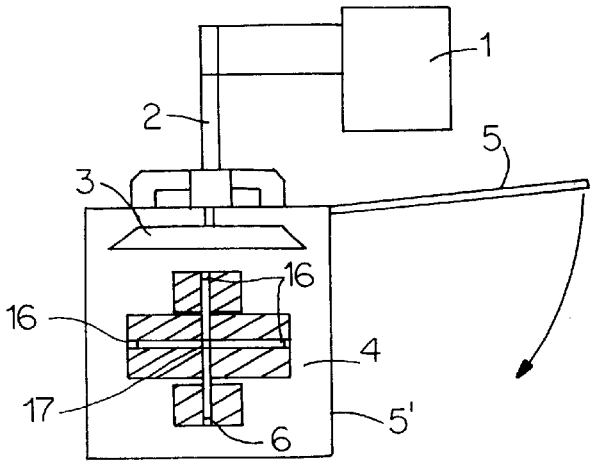
FIG. 2 is a cross-section along line A—A of FIG. 1.

FIG. 2 shows the side wall of the cavity 4 with an openable door 5 to permit a timber carriage to be inserted and removed from the cavity 4. The carriage comprises four support arms 16 emanating radially from a central hub 17. The timber is supported on the arms 16 and is rotated about the central hub 17 by a motor 7. The arms 16 can be supported on load cells 8 from which the weight of the wood and carriage can be sensed, thereby permitting the change in weight of the wood to be monitored during drying. In the embodiment shown, the carriage has in addition to the arms 16 at each end of the cavity, a set of arms in the centre the cavity to support the timber along its length during drying. The timber may instead or in addition to being rotated, be "shuffled" in an oscillatory motion by moving the carriage back and forth in a generally horizontal plane and/or in a generally vertical plane. In addition or instead, the timber may be subjected to oscillation or rotating the timber, preferably about the central hub, alternately in one direction of rotation and then in the other direction of rotation. This helps to achieve a uniform irradiation of the timber. The microwave energy is distributed within the cavity 4 using devices such as mode stirrers 3, phase change devices and power adjusting devices.

The weight sensing means 8 are used in addition to the humidity sensors 9, 12 as a control input to control means for varying the air flow through the cavity.

FIG. 3

Figure 3:
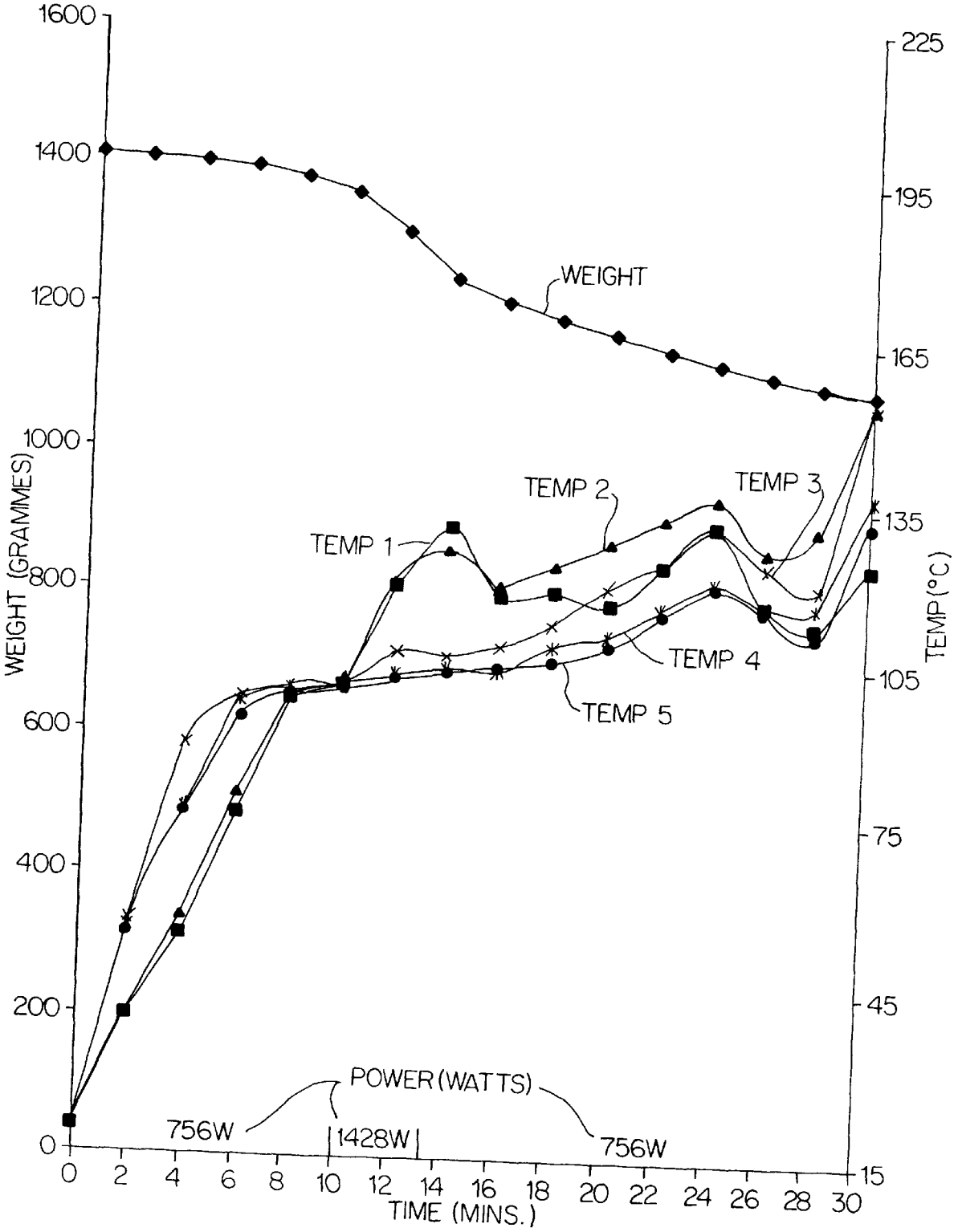
FIG. 3 is a plot of temperature and weight against time for an exemplary quantity of timber being dried in the apparatus of FIG. 1.

This is a graph showing the weight and temperature of a block of ash approximately 205 mm ×320 mm ×30 mm. The upper plot shows the weight reduction in the block as the moisture is removed. In this particular experiment, the temperature peak at 13 minutes corresponded to a popping sound being produced by the wood. The sound would have been caused by rupturing of the structure of the block. This peak is undesirable and the power should preferably be controlled to achieve a temperature curve similar to that of Temp 5" on FIG. 3. This peak also corresponds to an increased drying rate (as shown by the steeper weight curve between 10 and 15 minutes). By producing such a plot for a particular type of wood, it is possible to determine a safe maximum drying rate which can then be entered into the control means to ensure that the power output of the microwave generator is controlled appropriately for subsequent pieces or blocks of timber.

It will be noted that all the temperature curves rise steeply as the wood becomes dry. This steep rise may be used to determine when the wood is dry.

What is claimed is:

1. A timber drying apparatus for containing a quantity of timber to be dried, said timber drying apparatus comprising:

a housing defining at least one interior cavity and said housing having at least one aperture for providing access to the at least one interior cavity of the housing;

temperature sensing means located within the housing for sensing a temperature of the timber to be dried when located within the at least one interior cavity of the housing;

means for heating the timber contained within the housing; and control means for varying the means for heating the timber in response to the sensed temperature of the timber to be dried;

wherein the means for heating is a microwave generator (1);

the microwave generator (1) is coupled to the at least one interior cavity (4) of the housing by at least two ducts (2) for supplying microwave energy from the microwave generator (1) to the at least one interior cavity (4) of the housing;

the temperature sensing means is arranged for measuring a surface temperature of the timber to be dried when located within the at least one interior cavity (4) of the housing;

weight sensing means (8) for sensing a weight of the timber to be dried when located within the at least one interior cavity (4) of the housing; and the control means regulates the microwave energy in response to the sensed temperature and the sensed weight.

2. The apparatus according to claim 1, wherein ventilation means (10, 11), which communicates with the housing, is provided to convey air through the at least one interior cavity (4) of the housing to regulate at least one of air humidity and air temperature within the at least one interior cavity (4) of the housing.

3. The apparatus according to claim 2, wherein the ventilation means (10, 11) is coupled to the control means and includes a humidity sensor (9, 12) for generating and supplying an output signal representing a humidity of air in a vicinity of the humidity sensor; and the output signal is supplied to the control means and used as an input to regulate operation of the ventilation means (10, 11).

4. The apparatus according to claim 1, wherein a timber carriage (16) supports the timber to be dried within the at least one interior cavity (4) of the housing.

5. The apparatus according to claim 4, wherein motion means (7) is coupled to the timber carriage (16) for imparting one of an oscillatory motion and a rotatory motion to the timber to be dried and supported by the timber carriage (16) within the at least one interior cavity (4) of the housing.

6. The apparatus according to claim 1, wherein stirring means (3) is provided within the at least one interior cavity (4) of the housing and the stirring means (3) are operable to vary a spatial distribution of the microwave energy supplied to the at least one interior cavity (4) of the housing by the microwave generator (1).

7. The apparatus according to claim 1, wherein the at least one aperture has a closure (5) for closing the at least one aperture, and the closure is openable to provide access to the at least one interior cavity (4) of the housing, by way of the at least one aperture, whereby the timber to be dried can be one of inserted into and removed from the at least one cavity (4).

8. The apparatus according to claim 1, wherein a plurality of apertures are provided in the housing, each of the plurality of apertures has a closure (5) for closing each respective aperture, and each closure is openable to provide access to the respective interior cavity (4) of the housing whereby the timber to be dried can be one of inserted into and removed from the respective cavity (4).

9. The apparatus according to claim 1, wherein the temperature sensing means (13) comprises at least one infrared pyrometer for measuring the surface temperature of the timber to be dried located within the at least one interior cavity (4) of the housing.

10. The apparatus according to claim 1, wherein the temperature sensing means (13) includes at least one fibre optic temperature sensor.

11. The apparatus according to claim 1, wherein the control means (8) is operable to derive a measurement of a drying rate rate of change of in a weight of the timber to be dried and located within the at least one interior cavity (4) from the sensed weight.

12. The apparatus according to claim 11, wherein the control means (8) is arranged to control a power output of the microwave generator (1) to ensure that the drying rate of the timber to be dried within the at least one interior cavity (4) of the housing, is maintained below a predetermined maximum drying rate.

13. The apparatus according to claim 11, wherein the control means indicates that the timber to be dried within the at least one interior cavity (4) of the housing is sufficiently dry when at least one of the following occurs:

the drying rate of the timber over a predetermined time lies between zero and a predetermined maximum value; and a total weight loss during drying is at least equal to a predetermined minimum weight loss.

14. The apparatus according to claim 1, wherein the microwave generator (1) produces a continuous power output.

15. The apparatus according to claim 1, wherein the microwave generator (1) produces an intermittent power output.

16. A timber drying apparatus for containing a quantity of timber to be dried, said timber drying apparatus comprising:

a housing defining at least one interior cavity and said housing having at least one aperture for providing access to the at least one interior cavity of the housing;

a temperature sensing mechanism located within the housing for sensing a temperature of the timber to be dried when located within the at least one interior cavity of the housing;

a mechanism for heating the timber contained within the housing; and a control mechanism for varying the mechanism for heating the timber in response to the sensed temperature of the timber to be dried;

wherein the mechanism for heating is a microwave generator (1);

the microwave generator (1) is coupled to the at least one interior cavity (4) of the housing by at least two ducts (2) for supplying microwave energy from the microwave generator (1) to the at least one interior cavity (4) of the housing;

the temperature sensing mechanism is arranged for measuring a surface temperature of the timber to be dried when located within the at least one interior cavity (4) of the housing;

weight sensing mechanism (8) for sensing a weight of the timber to be dried when located within the at least one interior cavity (4) of the housing; and the control mechanism regulates the microwave energy in response to the sensed temperature and the sensed weight.

17. A method of drying timber within a housing containing a quantity of timber to be dried, temperature sensing means being arranged to sense a temperature of the timber to be dried within the housing, means for heating timber contained within the housing along with control means for varying the means for heating the timber to be dried in response to a sensed temperature, said method comprising the steps of:

forming the housing as to serve as a microwave cavity (4), measuring the temperature of the timber to be dried by sensing a surface temperature of the timber to be dried;

supplying microwave energy, via a microwave generator (1), into the at least one interior cavity (4) of the housing at the timber to be dried;

repeatedly sensing a weight and a temperature of the timber to be dried and located within the at least one interior cavity (4) of the housing; and controlling power of the microwave energy, supplied by the microwave generator (1) to the at least one interior cavity (4) of the housing, in response to a sensed weight and a sensed temperature of timber to be dried in the cavity (4).

* * * * *